US007042422B2

(12) United States Patent
Weitbruch et al.

(10) Patent No.: US 7,042,422 B2
(45) Date of Patent: May 9, 2006

(54) METHOD AND DEVICE FOR PROCESSING VIDEO PICTURES

(75) Inventors: Sébastien Weitbruch, Mönchweiler (DE); Cedric Thebault, Villingen-Schwenningen (DE); Axel Goetzke, Villingen-Schwenningen (DE)

(73) Assignee: Thomson Licensing, Boulogne-Billancourt (FR)

( * ) Notice: Subject to any disclaimer, the term of this patent is extended or adjusted under 35 U.S.C. 154(b) by 268 days.

(21) Appl. No.: 10/225,985

(22) Filed: Aug. 22, 2002

(65) Prior Publication Data

US 2003/0057894 A1 Mar. 27, 2003

(30) Foreign Application Priority Data

Aug. 23, 2001 (EP) ..... 01250304

(51) Int. Cl.
*G09G 5/04* (2006.01)
*G09G 3/10* (2006.01)

(52) U.S. Cl. ..... 345/63; 345/77; 345/83; 345/204; 345/690; 348/797; 315/169.4

(58) Field of Classification Search ..... 345/55–103, 345/204, 87–104, 208–210, 690–692; 315/169.1–169.4; 348/797

See application file for complete search history.

(56) References Cited

U.S. PATENT DOCUMENTS

| | | | | |
|---|---|---|---|---|
| 4,907,862 | A * | 3/1990 | Suntola | 345/88 |
| 6,014,258 | A * | 1/2000 | Naka et al. | 359/618 |
| 6,034,655 | A * | 3/2000 | You | 345/60 |
| 6,151,004 | A * | 11/2000 | Kaneko | 345/88 |
| 6,225,967 | B1 * | 5/2001 | Hebiguchi | 345/88 |
| 6,392,620 | B1 * | 5/2002 | Mizutani et al. | 345/88 |
| 6,573,882 | B1 * | 6/2003 | Takabayashi | 345/102 |
| 6,703,991 | B1 * | 3/2004 | Salters et al. | 345/63 |
| 6,825,823 | B1 * | 11/2004 | Taira et al. | 345/88 |
| 2003/0210354 | A1 * | 11/2003 | Thebault et al. | 348/797 |

FOREIGN PATENT DOCUMENTS

| | | |
|---|---|---|
| EP | 0896317 | 2/1999 |

* cited by examiner

*Primary Examiner*—Lun-yi Lao
(74) *Attorney, Agent, or Firm*—Joseph S. Tripoli; Harvey D. Fried; Sammy S. Henig

(57) ABSTRACT

The differences between the time responses of phosphor elements of a plasma display panel (17) shall be reduced by signal processing means without a need of a motion estimator. Therefore, the sub-fields for driving the luminous elements are reorganized in at least two groups of sub-fields arranged one after the other within one frame period. Luminous elements with long time responses are driven by the sub-fields of the first group and luminous elements with short time responses are driven by sub-fields of the first and second group. Thus, the phosphor lag effects are reduced.

9 Claims, 6 Drawing Sheets

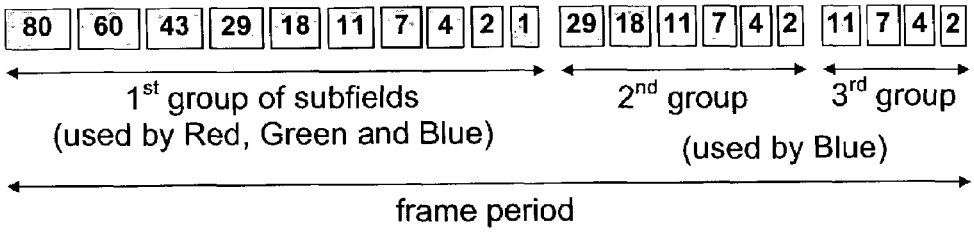
Fig. 5
| 10 SF code for green and red | | Equivalent code for blue | | | | | |
|---|---|---|---|---|---|---|---|
| 0000001101 | (10) | 0000000010 | (4) | 000010 | (4) | 0001 | (2) |
| 0000011010 | (20) | 0000001101 | (10) | 000011 | (6) | 0001 | (2) |
| 0000111100 | (40) | 0000011101 | (23) | 000111 | (13) | 0010 | (4) |
| 0001101110 | (60) | 0000111001 | (37) | 001011 | (17) | 0011 | (6) |
| 0010111011 | (80) | 0001011010 | (49) | 001111 | (24) | 0100 | (7) |
| 0011101011 | (100) | 0001101110 | (60) | 010111 | (31) | 0101 | (9) |
| 0101101110 | (120) | 0010101110 | (74) | 011011 | (35) | 0110 | (11) |
| 0111101011 | (160) | 0011101011 | (99) | 101011 | (46) | 1010 | (15) |
| 1101101110 | (200) | 0001111111 | (120) | 110111 | (60) | 1101 | (20) |
| 1111111111 | (255) | 0111101011 | (160) | 111111 | (71) | 1111 | (24) |
Fig. 6
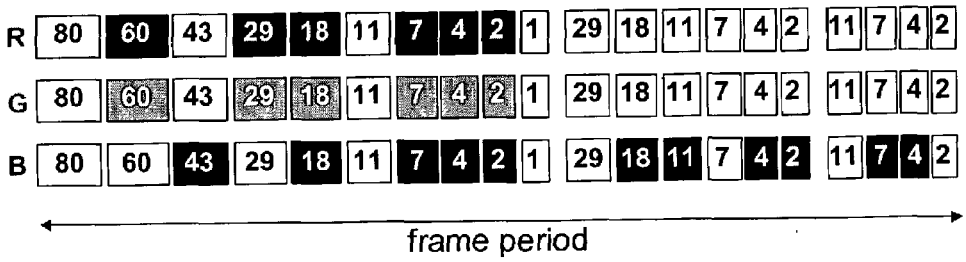
Fig. 7

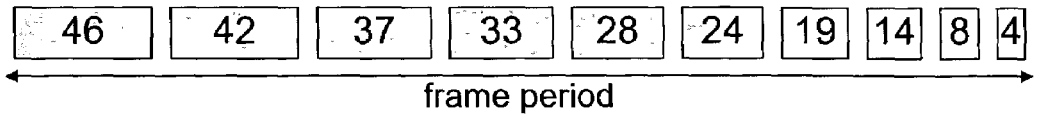
Fig. 10
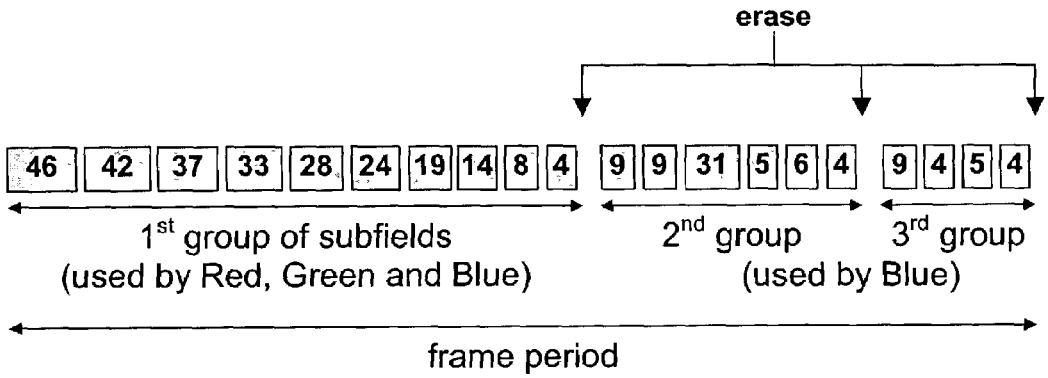
Fig. 11
| 10 NFC code | Final code | | |
|---|---|---|---|
| 0000000001 | 0000000000 | 000001 | 0000 |
| 0000000011 | 0000000001 | 000001 | 0001 |
| 0000000111 | 0000000011 | 000011 | 0001 |
| 0000001111 | 0000000111 | 000011 | 0011 |
| 0000011111 | 0000001111 | 000111 | 0011 |
| 0000111111 | 0000011111 | 000111 | 0111 |
| 0001111111 | 0000011111 | 001111 | 0111 |
| 0011111111 | 0000111111 | 001111 | 1111 |
| 0111111111 | 0001111111 | 011111 | 1111 |
| 1111111111 | 0011111111 | 111111 | 1111 |
Fig. 12

METHOD AND DEVICE FOR PROCESSING VIDEO PICTURES

BACKGROUND OF THE INVENTION

The present invention relates to a method and a device for processing video pictures for display on a display device having at least two kinds of luminous elements with different time responses, a first kind of luminous elements having a first time response and a second kind of luminous elements having a second time response, wherein the first time response is slower than the second time response. Particularly, the present invention is related to the reduction of the phosphor lag artefacts caused by the different time responses of the luminous phosphor elements.

Though they are known for many years, plasma displays are encountering a growing interest from TV manufacturers. Indeed, this technology now makes it possible to achieve flat color panels of large size (out of the CRT limitations) and with very limited depth without any viewing angle constraints.

Referring to the last generation of European TV, a lot of work has been made to improve its picture quality. Consequently, the new Plasma technology has to provide a picture quality as good or better than the old standard TV technology. On the one hand, the Plasma technology gives the possibility of "unlimited" screen size, of attractive thickness, but on the other hand, it generates new kinds of artefacts, which could damage the picture quality. Most of these artefacts are different to those of known TV pictures and so more visible since people are used to seeing old TV artefacts unconsciously.

One of these artefacts is called the "phosphor lag" and is due to the different time responses of the luminous materials making the different colour components used in the panel. This difference generates a kind of yellowish trail behind and a blue area in front of the bright objects moving on a dark background mainly (or the opposite).

FIG. 1 shows the simulation of such a phosphor lag effect on a natural scene with a movement basically in the vertical direction, where the moving white trouser-leg in front of the black background generates such trail.

On a plasma panel, the red, green and blue luminous elements (also named phosphors while not necessarily having the chemical element P) do not have the same properties because of the chemical properties of each phosphor. In addition the life duration and the brightness are privileged at the expense of behaviour homogeneity. Measurements show that the green phosphor is the slowest, the blue one is the fastest and the red one is mostly in-between. Thus, behind a white object in motion, there is a yellow-green trail, and in front a blue area, as illustrated in FIG. 2. Since the red (R), green (G) and blue (B) cells have different response times, at the front and rear of a moving object like a white block, the concerning pixels are discolored.

In the future, the development of new chemical phosphor powders could avoid such problems by making the green and red phosphors quicker. Nevertheless, today it is not possible by signal processing only to completely suppress this effect but one can try to reduce it.

One known solution from the former patent application FR 0010922 of Thomson multimedia is to compensate the coloured trail while modifying the blue component in the temporal domain.

The most cumbersome on the phosphor lag effect is not the trail behind moving objects but its colour. Another solution is therefore to add a complementary trail on the color trail in order to discolor it or to add to the pixels in front of the moving object a complementary correction at least for the cells having the fastest response. These solutions are disclosed in another European Patent Application of the applicant EP 01250237.3.

These ideas applied together in a PDP give very good results, but need the implementation of a motion estimator.

SUMMARY OF THE INVENTION

The object of the present invention is to disclose a solution that compensates for the differences between the time responses of the three phosphors without the need of a motion estimator.

According to the present invention this object is solved by the method of claim 1 and the device of claim 8.

In case of Plasma Display Panel (PDP), the frame period is divided in lighting periods called sub-fields. Usually the whole frame period is divided into sub-fields and the three colour components RGB use the same sub-field organisation (for a same video value, they are switched on and off at the same time), and so as the red and the green phosphors are slower than the blue one, the phosphor lag artefact occurs.

This invention proposes a new sub-field organization which reduces the phosphor lag artefact, and which may be characterized by an increased number of sub-fields. It is the general idea of the invention to build two or more sub-field groups in a frame period. In a specific embodiment three sub-field groups may be created in a frame period, and the idea is to translate (particularly for the blue component) some sub-fields from the first sub-field group into the two other groups as if the phosphors were switched on and off later in order to simulate the phosphor lag. Thus, the first sub-field group is used to fully code the red and the green components, and partially the blue one. The second and the third sub-field groups are used to simulate the phosphor lag.

In case of three different cell types such as present in colour plasma displays corresponding to the colour components RGB the extra sub-field group/s can also be used for generating light in the cells having the mid range time response, i.e. red luminance material plasma cells to make an optimised compensation. As the differences in time responses between red and green plasma cells is inferior in comparison to the differences between blue and red or between blue and green cells, it is sufficient to use the extra group/s of sub-fields for the blue plasma cells only.

The solution according to the invention has the great advantage that the implementation of the compensation method performs good and is very simple to implement. There is no need to implement a motion estimator.

A drawback of the solution is that the extra sub-field groups occupy a part of the frame period and cannot be used to generate more light pulses in order to enhance the contrast. This problem can be avoided if the compensation method is simply switched off in video scenes where the contrast is regarded most important.

The compensation method can be used for different types of sub-field coding schemes. It can be used in connection with the conventional ADS (Address, Display, Separated) driving scheme, where each sub-field consists of the three periods addressing, sustaining and erasing. It can likewise be used in connection with the incremental driving scheme where no sub-field code words are used in which there is a sub-field inactivated beween two activated sub-fields or vice versa.

Further favorable developments of the method and device of the present invention are defined in the subclaims.

It is e.g. very advantageous if in the three sub-field groups, the sub-fields are arranged in decreasing order to let the biggest sub-fields lag on their own group.

BRIEF DESCRIPTION OF THE DRAWINGS

Exemplary embodiments of the invention are illustrated in the drawings and are explained in more detail in the following description. The drawings show in:

FIG. 5 a sub-field organization according to the present invention;

FIG. 6 examples of a transformation of some basic 10 sub-fields code words to sub-field code words using the sub-fields of all three sub-field groups;

FIG. 7 an example of coding a white pixel with a luminance value of 120 for each colour component by dividing the blue component among the three sub-field groups;

FIG. 10 a second example of a sub-field organisation of a basic 10 sub-fields code;

FIG. 11 a second example of a sub-field organization according to the present invention based on the example of FIG. 10;

FIG. 12 the transformation of the basic 10 sub-fields incremental code words for the sub-field organisation of FIG. 10 to sub-field code words using the sub-fields of all three sub-field groups shown in FIG. 11;

DESCRIPTION OF THE PREFERRED EMBODIMENTS

In the following the present invention will be explained in more detail along with two different embodiments.

Figure 1:
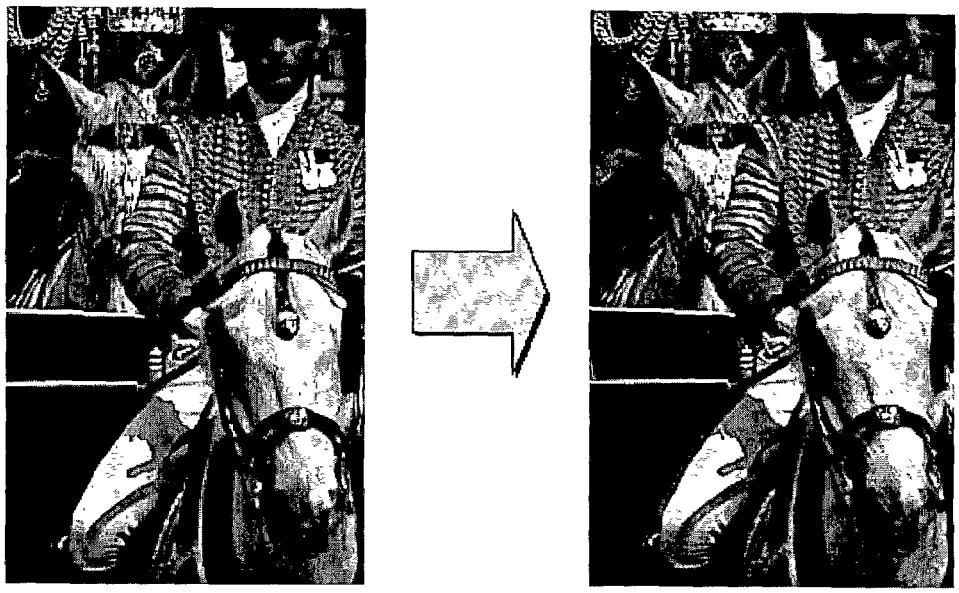
FIG. 1 the simulation of a phosphor lag effect on a natural scene.
Figure 3:
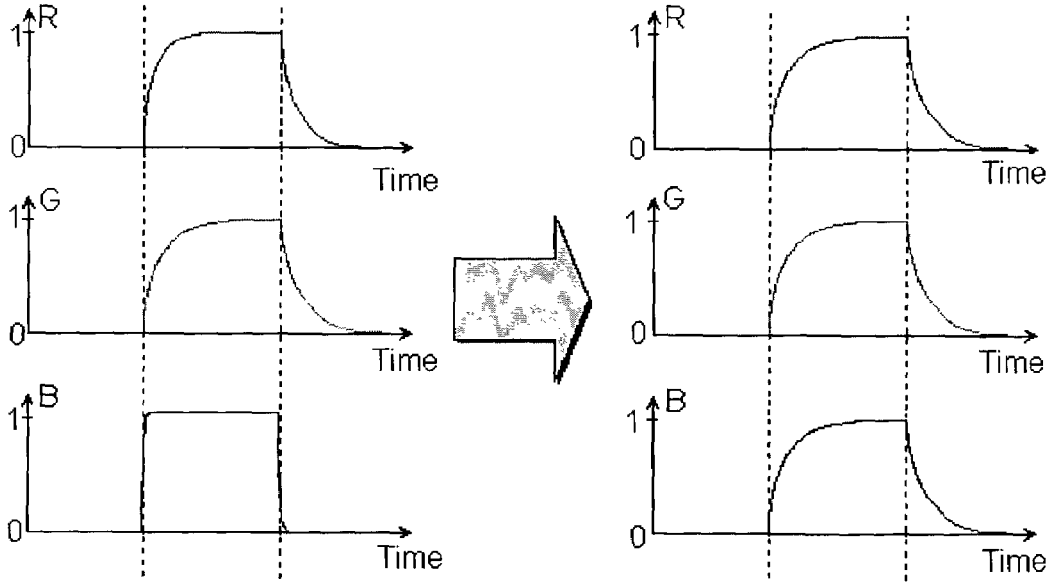
FIG. 3 the time responses of a red, green and blue phosphor element and the compensated time responses according to the present invention.

The phosphor lag problem is a result of the difference in the time responses of the phosphors. As it is impossible to make the green and the red phosphors (the slowest) faster only by signal processing, at least the blue one has to be made slower as illustrated in FIG. 3. On the left of FIG. 3 the real time responses for the red, green and blue phospors is shown. On the right side the time response of the blue phosphor is adapted to the time responses of the red and green phosphors. This compensation is done by signal processing means as described hereinafter.

As said before, according to the invention the frame period is divided in three periods for three sub-field groups in order to make the blue component simulate the phosphor lag.

The code that is used for sub-field coding in the three sub-field groups is based on a standard decreasing 10 sub-fields code in the first disclosed embodiment. This code will be used for the first sub-field group for driving the red and the green phosphor elements.

As the two other sub-field groups are only used by the blue component and as the trail due to phosphor lag is decreasing fastly, less sub-fields can be used for the secondary periods.

So for example, if 10 sub-fields are used for the first period (the basic one), 6 sub-fields can be used for the second and 4 for the third sub-field group.

The reason why decreasing codes are used is that the sub-fields with the biggest weights represent the most part of the energy flow, and so the most part of the phosphor lag. When placing them first, they will lag mainly on the group they belong to, thereby reducing the phosphor lag problem.

To simulate the phosphor lag for the blue signal component, the video values for the blue component are split in three parts (one for each sub-field group). The value for the first part is smaller than normally (i.e. when the blue component is only coded with the basic 10 sub-fields code), so less sub-fields will be activated in the first group, that has the effect that the blue component is switched on later in comparison to the red and green signal component and that means that the "impulse response" is made similar to that of the red and green phosphors. The two other parts are used to simulate the lag when the green phosphor is switched off.

It can be seen that the picture quality corresponds to a 10 sub-fields code, the cost almost corresponds to a 20 (10+6+4) sub-fields code, and the luminance corresponds to half of the one obtained with a basic 20 sub-fields code.

EXAMPLE

The principles of this invention are best explained by means of an example. It should be here strongly noted that values in an actual implementation may differ from those here shown, in particular the number and weight of the used sub-fields.

Figure 4:
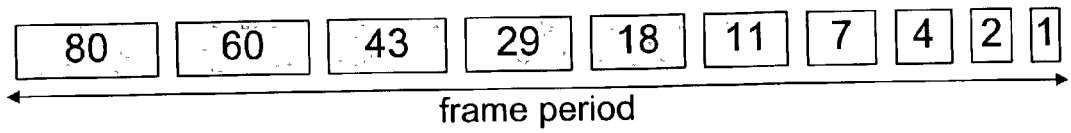
FIG. 4 an example of a sub-field organisation of a basic 10 sub-fields code.

An example of a basic 10 sub-fields code is shown in FIG. 4. The numbers given in each sub-field correspond to the relative sub-field weight. The sum of the sub-field weights correspond to 255 which is the highest possible video value in 8-bit representation.

An example of a possible sub-field organization for phosphor lag reduction, according to this invention is shown in FIG. 5. As shown in FIG. 5 the $1^{st}$ sub-field group is identical to the standard 10 sub-fields organization of FIG. 4. The second sub-field group has the the similar structure as the $4^{th}$ to $9^{th}$ sub-field of the first group and the third group has the same structure as the $6^{th}$ to $9^{th}$ sub-field of the first group.

So as said before, the values for the red and green colour components are coded solely with the basic 10 sub-fields code of the first group whereas the blue values are coded with the sub-fields of all three groups. Some examples of encoding video levels according to both possibilities are shown in FIG. 6. In FIG. 6 an entry "1" in the code words corresponds to a sub-field activation (means light generation on), and "0" to a sub-field inactivation (means light generation off). The code words for the other video values in the range of 0 to 255 can be derived by distributing the video values among the three parts accordingly, e.g. with a function calculating the corresponding percentages. Of course some rounding needs to be done and for an optimisation some experiments to make a fine tuning should also be done for the corresponding panel technology.

The line in FIG. 6 marked with arrows corresponds to an example that will be analysed in more detail in the following.

In this example a video value of 120 is given. The first code (on the left) is the code used for the red and the green components, the second one (on the right) is the equivalent code used for the blue component.

For example, a value of 120 for blue, which corresponds to 0101101110 in 10 sub-field code, shall be considered (60+29+18+7+4+2=120). This value is divided into 3 parts: 74, 35 and 11 (74+35+11=120), which simulate the phosphor lag of a value of 120 for the green using the 10 sub-fields code. Finally, the three parts are coded as depicted in FIG. 7 and one obtains the final code 0010101110 011011 0110.

So, for a white pixel (having the same video value for all the three components) with a value of 120 , the code of FIG. 7 is obtained.

It can be noticed from FIG. 7 that the light generation for the blue component is delayed by around 1 sub-field compared to the green and the red component.

In the above explained examples of the present invention, only the blue component is changed, so the phosphor lag artifact is not totally compensated because there is still some difference in time response between red and green plasma cells.

Figure 8:
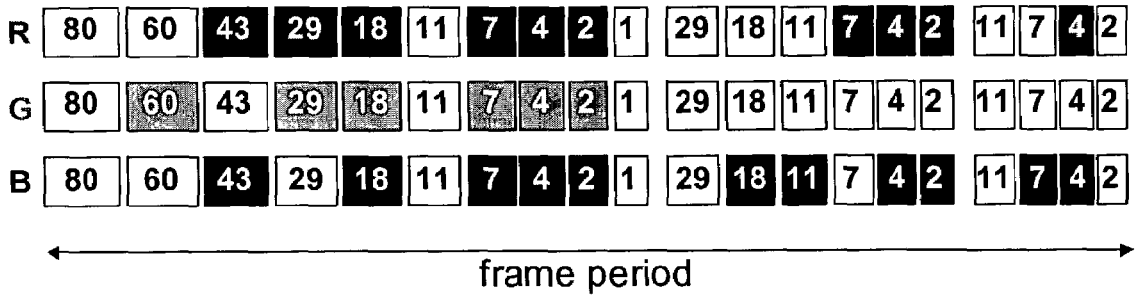
FIG. 8 an example of coding a white pixel with a luminance value of 120 for each colour component by dividing the blue and red components among the three sub-field, groups.

In fact, it is possible to totally discolor the trail by changing the red component, too (the slowest, the green, will always have to be coded solely with the first group of sub-fields). In this case the coding process for both components blue and red will use the three groups of sub-fields, but with different codings. For the example having a video value of 120 in all three components, the codings shown in FIG. 8 could be used.

Figure 2:
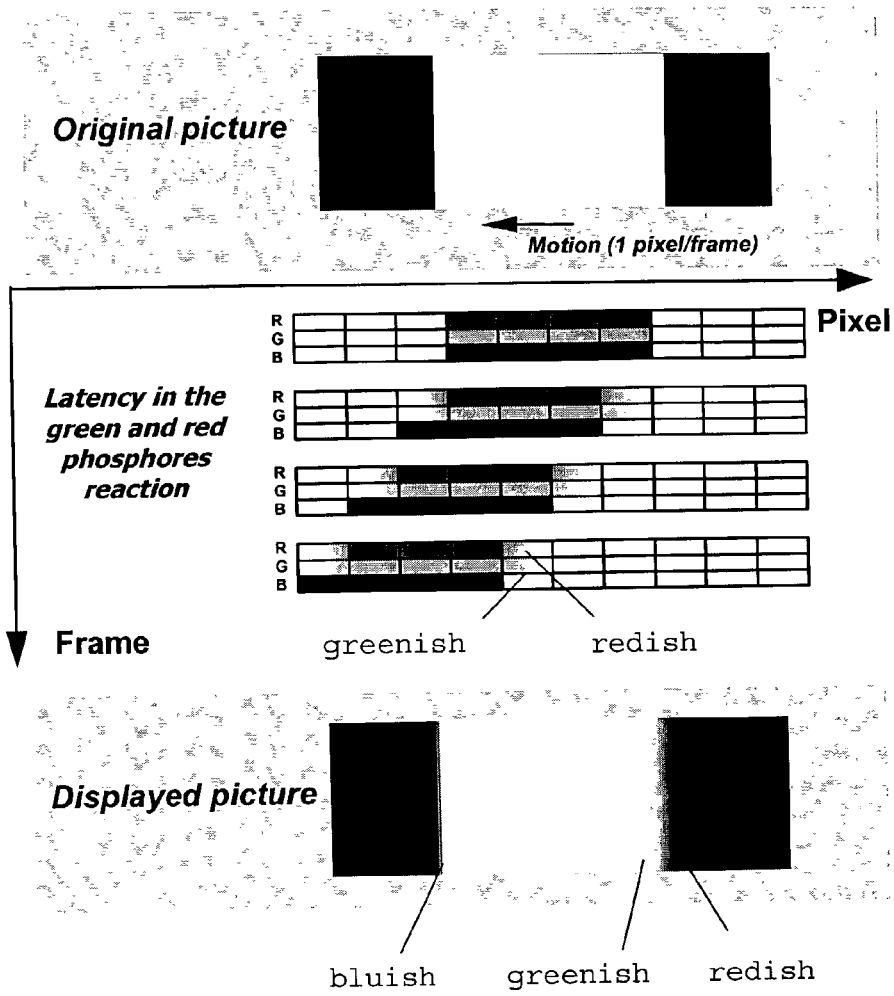
FIG. 2 the latency of light generation in the red and green plasma cells for the case of a white rectangle moving on a plasma display screen.
Figure 9:
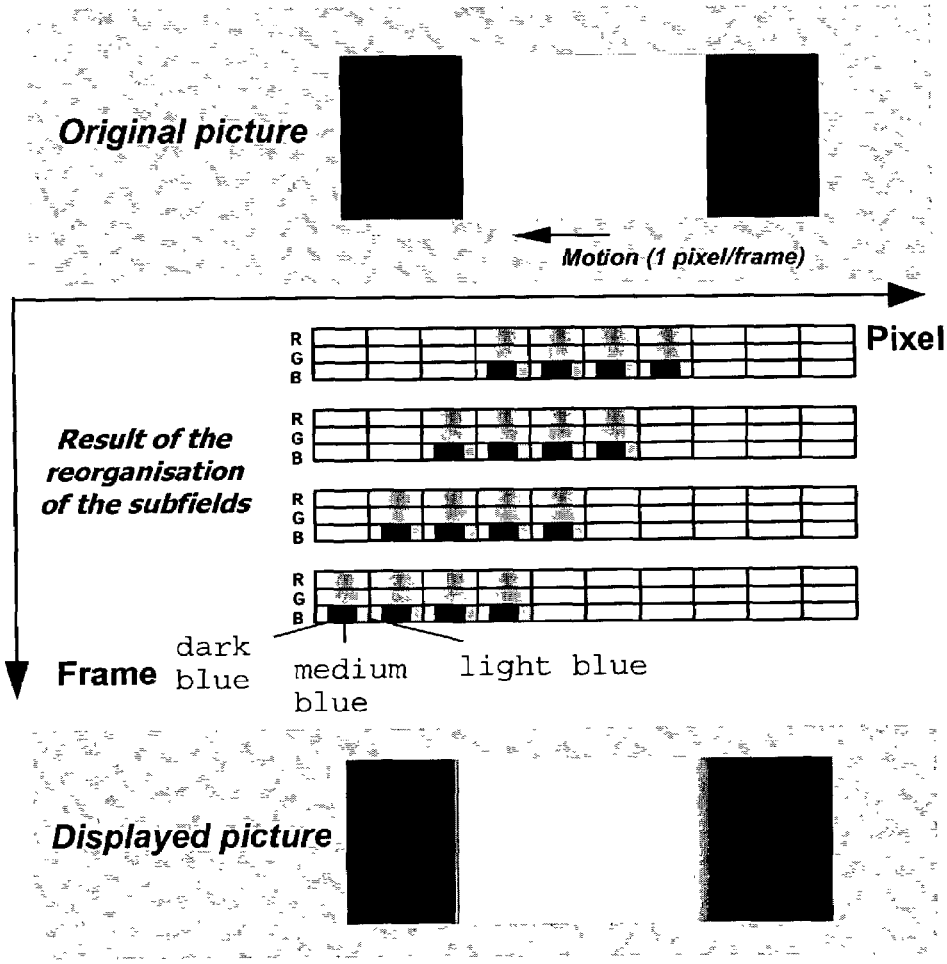
FIG. 9 a simulation of the light generation in the plasma cells R,G,B for the case of a white rectangle moving on a plasma display screen similar to FIG. 3, but in case that the compensation method according to the present invention is used.

FIG. 9 illustrates the simulation of the compensation method according to the principle of FIG. 7 for the case of the white square moving on a black background as presented in FIG. 2.

In each box (each representing one phosphor element of one pixel), the time response is represented in respect to the new sub-field reorganization and to phosphor lag of the red and green elements. The green and the red elements are only on at the beginning of the frame period, but because of the phosphor lag, they also seem to be on later, whereas the blue element is really switched on and off later.

Finally the result obtained with this new sub-field organization is an uncolored trail as shown on the bottom of FIG. 9

Next, a second embodiment of the invention will be explained. As already mentioned in the introductory part of the application the invention can be be used in connection with the incremental driving/coding scheme where no sub-field code words are used in which there is a sub-field inactivated beween two activated sub-fields or vice versa. The second embodiment is dedicated to this incremental driving/coding scheme.

FIG. 10 shows a possible 10 sub-field organisation similar to FIG. 4 but with different sub-field weights. According to the invention three sub-field groups are created for phosphor lag reduction. Each of the groups will be coded with the incremental driving/coding scheme. A speciality of this coding scheme is that not every sub-field has an erasing period. The erasing operation will be performed for all previous sub-fields at the end of each sub-field group. The incremental driving/coding scheme has the great advantage that it totally suppresses the dynamic false contour effect. It has on the other hand the disadvantage of a poor grey scale portrayal because the sub-fields code words for the full video level range 0–255 is greatly decimated. In a 10 sub-field organisation only 11 sub-field code words are admissible inclusive Zero. For more details regarding the incremental sub-field driving/coding it is refferred to EP-A-0 952 569 and another European Patent Application of the applicant with the number EP 00403366.8.

FIG. 11 shows the sub-field organisation including the extra two sub-field groups. It is mentioned that the decreasing order of sub-field weights is kept solely in the $1^{st}$ group only. Experiments have shown that some better results could be achieved in this embodiment if the rule is not kept in the second and third sub-field group.

FIG. 12 presents the admissble code words according to incremental coding on the left side and its transformation to corresponding phosphor lag simulation code words on the right. In this case the table is complete. The code words on the left side are used for driving the red and the green plasma cells. On the right side the equivalent code words for the blue palsma cells are given.

As an example we consider a video value of 130 for the blue component, which corresponds to 0001111111 in the 10 sub-field code (33+28+24+19+14+8+4=130). This value is divided into 3 parts: 69, 48 and 13 (69+48+13=130), which simulate the phosphor lag of a value of 130 for the green using the 10 sub-field code. Finally, we obtain the code 0000011111 001111 0111 (24+19+14+8+4=69; 31+5+6+4=48; 4+5+4=13).

Figure 13:
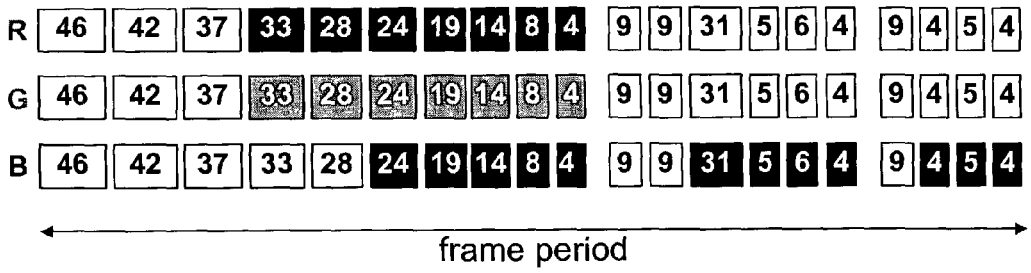
FIG. 13 an example of coding a white pixel with a luminance value of 120 for each colour component by dividing the blue component among the three sub-field groups shown in FIG. 11.

So, for a white pixel having the same value for all three components with a value of 130, we obtain the code words shown in FIG. 13. From this figure it is evident that the blue plasma cells are activated delayed by two sub-fields compared to the red and green plasma cells. The afterglow of the blue plasma cells is artificially assured by activating the cells in the $2^{nd}$ and $3^{rd}$ sub-field group, where the red and green cells remain inactivated.

Figure 14:
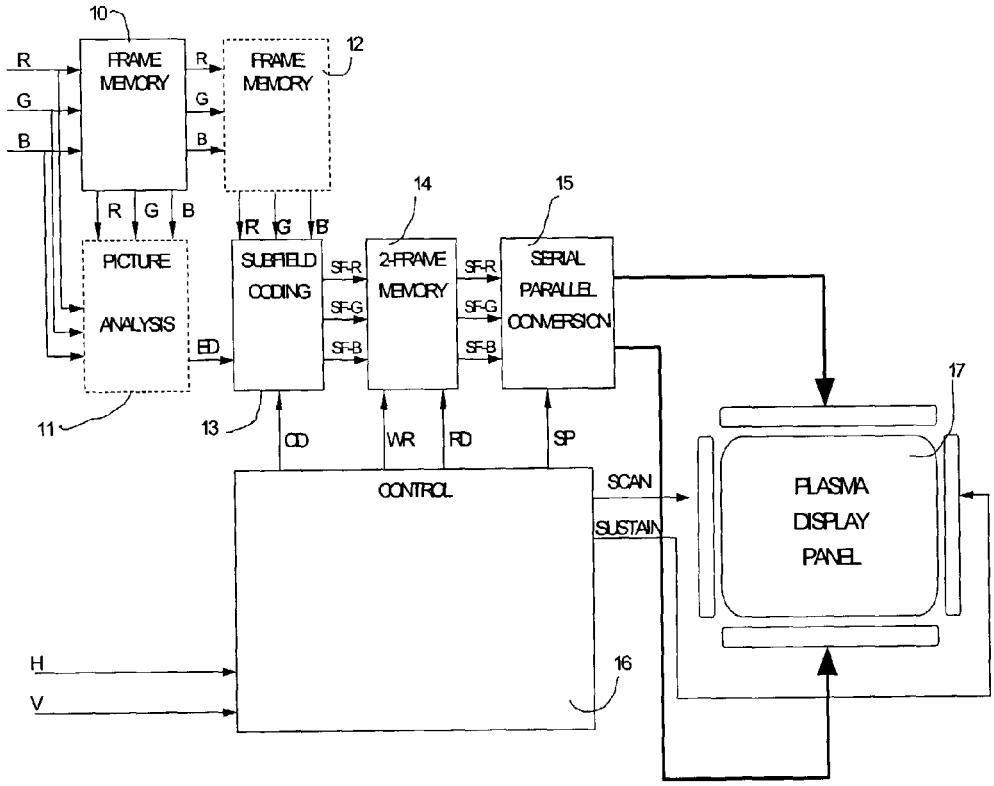
FIG. 14 a block diagram for a circuit implementation of the device according to the invention.

In FIG. 14 a circuit implementation of the invention is illustrated. Input R,G,B video data of a first frame $F_n$ is forwarded to a frame memory 10 and an optional picture analysis block 11. Picture analysis block 11 analyses the picture in the frame memory 10. If the block 11 outputs the analysis result that the picture has a number of critical transitions, the picture analysis block 11 switches over the sub-field coding process from standard coding to phosphor lag compensated coding. Different coding tables are recorded in the sub-field coding block 13 for this purpose.

The picture analysis block 11 includes a unit for edge detection. Algorithms for edge detection are known from the prior art. For example in EP-A-0 913 994 an algorithm is described with which it can be reliably detected whether a pixel lies on a horizontal transition. This algorithm is used for letterbox detection in this patent application but it could also be used for edge detection in modified form.

The picture analysis takes some processing time and this could cause that another frame memory 12 is necessary with which the sub-field coding process can take place while the picture analysis block 11 analyses the frame in frame memory 10. The R, G and B components from frame memory 12 are forwarded to sub-field coding unit 13 that performs sub-field coding under control of control unit 16. The sub-field code words are stored in memory unit 14. The external control unit 16 also controls reading and writing from and to this memory unit. The external control unit 16 also generates timing signals for the control of the units 10 to 12 (not shown). For plasma display panel addressing, the sub-field code words are read out of the memory device and all the code words for one line are collected in order to create a single very long code word which can be used for the line wise PDP addressing. This is carried out in the serial to parallel conversion unit 15. The control unit 16 generates all scan and sustain pulses for PDP control. It receives horizontal and vertical synchronising signals for reference timing. The plasma display panel has the reference number 17.

The general idea of this invention (dividing the frame period in sub-periods in order to reduce the differences of time responses between the different colors) is applicable to all displays presenting different time responses for the three colors and using sub-fields to make light (pulse width modulation).

What is claimed is:

1. A method for processing video pictures for displaying on a display device having at least two kinds of luminous elements with different time responses, a first kind of luminous elements having a first time response and at least a second kind of luminous elements having a second time response, the second time response being faster than the first time response, said method comprising:

driving each luminous element within a video frame or video field period by time impulses organized in sub-fields; wherein the time duration of a video frame or video field period is divided into a plurality of sub-fields during which the luminous elements can be activated for light emission in small pulses corresponding to a sub-field code word which is used for brightness control;

forming a first group of sub-fields for driving at least the first kind of luminous elements;

forming a second group of sub-fields for driving the second kind of luminous elements;

arranging the second group of sub-fields behind the first group of sub-fields within the video frame or video field period;

performing a sub-field coding process, in which sub-field code words are determined for driving the display, wherein for the sub-field code words that are used for activating light emission in the luminous elements of the first kind, active bit entries are made only for the sub-fields of said first group of sub-fields, and wherein for the sub-field code words that are used for activating light emission in the luminous elements of the second kind, active bit entries are made for the sub-fields of said first group and said second group of sub-fields;

forming at least a third group of sub-fields dedicated for driving the luminous elements of the second kind, and arranging the third group of sub-fields behind the sub-fields of the second group in the frame period and in the sub-field coding process generating sub-field code words that are used for activating light emission in the luminous elements of the second type, where active bit entries are made also for the sub-fields of said third group of sub-fields.

2. The method according to claim 1, wherein luminous elements of the first kind are red and green phosphor elements and luminous elements of the second kind are blue phosphor elements or luminous elements of the first kind are green phosphor elements and luminous elements of the second kind are red and blue phosphor elements.

3. A method for processing video pictures for displaying on a display device having at least two kinds of luminous elements with different time responses, a first kind of luminous elements having a first time response and at least a second kind of luminous elements having a second time response, the second time response being faster than the first time response, said method comprising:

driving each luminous element within a video frame or video field period by time impulses organized in sub-fields, wherein the time duration of a video frame or video field period is divided into a plurality of sub-fields during which the luminous elements can be activated for light emission in small pulses corresponding to a sub-field code word which is used for brightness control;

forming a first group of sub-fields for driving at least the first kind of luminous elements;

forming a second group of sub-fields for driving the second kind of luminous elements;

arranging the second group of sub-fields behind the first group of sub-fields within the video frame or video field period;

performing a sub-field coding process, in which sub-field code words are determined for driving the display, wherein for the sub-field code words that are used for activating light emission in the luminous elements of the first kind, active bit entries are made only for the sub-fields of said first group of sub-fields, and wherein for the sub-field code words that are used for activating light emission in the luminous elements of the second kind, active bit entries are made for the sub-fields of said first group and said second group of sub-fields, wherein in case of the same video values given for activating light emission in the luminous elements of the first and second kind different sub-field code words are generated for driving the luminous elements of the first and second kind, so that light emission in sub-fields of the first sub-field group for the luminous elements of the second kind is started later in the frame or field period than light emission in sub-fields of the first sub-field group for the luminous elements of the first kind.

4. A method for processing video pictures for displaying on a display device having at least two kinds of luminous elements with different time responses, a first kind of luminous elements having a first time response and at least a second kind of luminous elements having a second time response, the second time response being faster than the first time response, said method comprising:

driving each luminous element within a video frame or video field period by time impulses organized in sub-fields, forming a first group of sub-fields for driving at least the first kind of luminous elements, forming a second group of sub-fields for driving the second kind of luminous elements, and arranging the second group of sub-fields behind the first group of sub-fields within the video frame or video field period;

wherein luminous elements of the first kind are red and green phosohor elements and luminous elements of the second kind are blue phosphor elements or luminous elements of the first kind are green phosphor elements and luminous elements of the second kind are red and blue phosphor elements; and wherein the first group of sub-fields is used for driving red, green and blue phosphor elements and the sub-fields of the second group are used for driving at least one of the blue and red phosphor elements.

5. The method according to claim 4, wherein each sub-field has assigned a sub-field weight that determines the time duration during which the time pulses are generated, and the sub-fields in the groups are ordered with decreasing sub-field weights.

6. A device for processing video pictures for displaying on a display device having at least two types of luminous elements with different time responses and different colour, a first type of luminous elements having a first time response and at least a second type of luminous elements having a second time response, wherein the first time response is slower than the second time response, with driving control means for driving the luminous elements in sub-fields with small pulses, each sub-field having a sub-field weight that determines the time duration during which the small pulses are generated, sub-field coding means for assigning a sub-field code word to an input video value of a colour component the sub-field code word determining during which sub-field the luminous element will be activated, wherein;

the driving control means organize the sub-fields in at least two sub-field groups within a frame period and said sub-field coding means determine first sub-field code words for driving the first type of luminous elements and second sub-field code words for driving the second type of luminous elements, wherein the first type of sub-field code words comprise bit entries with which the light emission activation for the first type of luminous elements is made only with sub-fields belonging to the first group of sub-fields and wherein the second type of sub-field code words comprise bit entries with which the light emission activation for the second type of luminous elements is made with sub-fields of the first and second sub-field group.

7. The device according to claim 6, wherein the driving control means organize the sub-fields in at least three groups of sub-fields and the sub-field coding means determine sub-field code words for driving the second type of luminous elements with which an activation is made with sub-fields of the first, the second and third group of sub-fields.

8. The device according to claim 6, wherein in case of the same video values given for activating light emission in the luminous elements of the first and second type, the sub-field coding means produce different sub-field code words for driving the luminous elements of the first and second type, wherein in the sub-field code words for controlling light emission of the first and second type of luminous elements different bit entries are made, so that light emission in sub-fields of the first sub-field group for the luminous elements of the second type is started later in the frame or field period than light emission in sub-fields of the first sub-field group for the luminous elements of the first type.

9. The device according to claim 6, wherein it is integrated in a plasma display device or in a box that is connectable with a plasma display device.

* * * * *